United States Patent [19]

Byer

[11] 4,370,411

[45] Jan. 25, 1983

[54] METHOD FOR PRODUCING A LONG SCALE DIRECT-POSITIVE PHOTOGRAPHIC EMULSION

[75] Inventor: Richard J. Byer, Rochester, N.Y.

[73] Assignee: E. I. Du Pont de Nemours and Company, Wilmington, Del.

[21] Appl. No.: 186,291

[22] Filed: Sep. 11, 1980

[51] Int. Cl.[3] ..... G03C 1/36

[52] U.S. Cl. ..... 430/596; 430/569

[58] Field of Search ..... 430/596, 567, 569

[56] References Cited

U.S. PATENT DOCUMENTS

| | | | |
|---|---|---|---|
| 3,615,573 | 10/1971 | Smith et al. | 430/596 |
| 3,870,522 | 3/1975 | Moisav et al. | 430/596 |
| 4,023,972 | 5/1977 | Vanassche et al. | 430/596 |

*Primary Examiner*—Won H. Louie, Jr.

[57] ABSTRACT

A direct positive emulsion is produced by nonuniform fogging. The latter is conducted by varying the addition of the emulsion to fogging agent or by variable quenching of the fogging reaction. Films using such emulsion have extended exposure latitude or long scale, and the Density vs. Log Exposure curve is smooth and continuous.

5 Claims, 8 Drawing Figures

METHOD FOR PRODUCING A LONG SCALE DIRECT-POSITIVE PHOTOGRAPHIC EMULSION

BACKGROUND OF THE INVENTION

1. Field of the Invention

The present invention is directed to a fogged direct positive emulsion, and particularly a method of nonuniform fogging to produce a long scale (extended latitude) emulsion having a smooth and continuous Density vs. Log of Exposure (Log E) curve.

2. Description of the Prior Art

The simplest route to positive-positive photographic reproduction is provided by certain types of silver halide emulsions that are fogged in manufacture, and, on exposure and conventional development, yield direct positive images of the original subject matter. These emulsions are called prefogged direct positives. To give faithful reproductions it is desirable that the Density vs. Log Exposure curves of such emulsions have an extended exposure latitude, or long scale. In addition it is desirable that the curve shape be smooth and continuous.

Smith et al., in U.S. Pat. No. 3,615,573 "Direct-Positive Composition Containing Individually and Differently Fogged Silver Halide Emulsions" addressed the problem of extending the exposure latitude of a fogged direct positive emulsion by separating an unsensitized emulsion into two or more portions, individually fogging them to different levels, and applying these to a support, either in separate layers or as a blend. The result was a Density vs. Log E curve having one or more discrete high-contrast steps of exposure range of the photographic composition.

FIG. 1 of the drawings is a reproduction of a highly preferred embodiment of Smith et al, viz. FIG. 3 of U.S. Pat. No. 3,615,573. This illustrates how three separate emulsions of different degrees of chemical fogging can be combined to provide extended exposure latitude. While illustrating the steps which are produced by the combination of emulsions, this Figure also shows that techniques which involve mixing of emulsions of different sensitivities give Density vs. Log E curves which contain breaks, i.e., there are sharp changes in direction. Prior art techniques of mixing emulsions are characterized by such breaks since the net curve is really a superpositioning of the curve shapes of the different emulsions used and the break is representative of a transition from one emulsion to another.

However, given the complex nature of photographic emulsions, it is difficult to control the fogging process for even a single emulsion, much less maintain proper control over several emulsions so that, if desired, the transition from one step to another is more or less "smooth". Also, the blending of two emulsions of different speeds to produce a step or flat spot in the Density vs. Log E curve causes a region of reduced contrast in the midtones of the duplicate. The present invention proceeds in the opposite direction and provides a simpler means to extend exposure latitude, using only a single emulsion to obtain an essentially smooth curve.

SUMMARY OF THE INVENTION

The present invention provides a single chemically fogged direct positive emulsion having a multitude of photographic sensitivities within the emulsion, along with its process of manufacture. In a further embodiment the invention provides a photographic film characterized by (1) a Density vs. Log E curve which exhibits no discrete steps in the curve, and (2) an extended exposure latitude.

The chemical fogging may proceed by combining separate portions of emulsion and fogging agent over a period of time, using either constant or varying rates of addition of one to the other. In one embodiment, double jet fogging may be employed, i.e., a stream of unfogged silver halide emulsion is continuously pumped from a supply vessel to a receiving vessel, and at the same time a stream of chemical foggant is continuously pumped into and mixed with the emulsion in the receiving vessel. Continuously variable fogging of the emulsion by means of "double jet" metering the emulsion and foggant into a separate vessel over a period of time will produce low contrast and long scale without a flat spot in Density vs. Log E curve. A refinement to the method would be to vary the rate of addition of foggant while keeping the silver halide (emulsion) rate of addition constant, e.g., 25 ml/min. for 10 minutes, and after each 10 minutes reducing the rate by 5 ml/min. for the foggant while keeping the emulsion rate at 25 ml/min. Another variation is to combine the emulsion and fogging agent and continuously draw off the emulsion into a separate vessel which is below digestion temperature or contains a quenching solution. A further refinement is to meter the unfogged emulsion into a separate kettle while in-line injecting the foggant, or in-line injecting a quenching solution into the fogged emulsion. The end result of any of these techniques is to provide a single emulsion in which the silver halide grains have experienced nonuniform fogging, thereby providing extended exposure latitude (long scale) when the emulsion is used in a photographic element.

BRIEF DESCRIPTION OF THE DRAWINGS

FIG. 1 has been described above. FIG. 2 illustrates a conventional single emulsion curve.

FIG. 7 illustrates a double jet/aliquot fogging technique, and FIG. 8 illustrates a variable quenching technique.

DETAILED DESCRIPTION OF THE INVENTION

Figure 1:
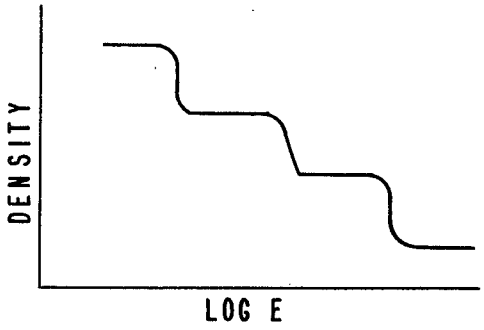
FIGS. 1 and 2 illustrate the prior art.

Silver halide grains useful for the present invention may be produced by techniques well known in the art. They may be heterodisperse or monodisperse, produced by splash, double jet, conversion, or core-shell techniques, and may incorporate metal ion dopants to modify photographic response. Sensitizing dyes, stabilizers, antifoggants, surfactants, and other photographic addenda may be used in conjunction with silver halide grains prepared according to the present invention.

A preferred reducing agent is cesium thiadecaborane, used in combination with gold salts to produce the nonuniform fogging of the present invention. The preferred emulsion grains are monodisperse. A preferred method of variable fogging employs a constant rate of addition of emulsion along with a gradually decreasing addition of the fogging agent.

Electron trapping cyanine dyes are particularly useful in these fogged direct positive emulsions. Organic halogen compounds as taught in Belgium Pat. No. 876,734 are also useful with the present invention.

A practical advantage of the present invention is that only a single emulsion need be produced in order to obtain the extended latitude or long scale response. As an alternative, it is possible to adapt the present invention to a continuous emulsion fogging and quenching process, whereas prior art techniques require blending different emulsions and cannot be employed for a single emulsion production. While the prior art teaches that separate emulsion batches must be prepared with discrete photographic properties determined by grain size and/or degree of fogging, the present invention introduces the concept of a spectrum of sensitivities within the grains which make up the single emulsion.

Whereas conventional prior art fogging techniques provided a chemical environment and digestion reaction which was uniform for all the silver halide grains within a particular batch, the present invention subjects the silver halide grains to a changing chemical environment and different degrees of digestion. As a consequence of the delibrate alteration of the fogging conditions the grains do not have uniform sensitivity to exposure. Conceptually, if one were able to examine individual grains from an emulsion prepared by the present invention, there would be a wide range of sensitivities from one extreme to another. Yet because there are also grains which differ in sensitivity by only very small increments, the net result is that there are no steps or breaks in the curve shape. The smooth and continuous curve shape of emulsion made by the present invention can be attributed to the nonuniform fogging which produces the extended exposure range.

The methods of carrying out the present invention including the best mode will be made clear by the following examples.

EXAMPLE 1

A monodisperse cubic grained gelatin iodobromide emulsion (1.4% iodide) was prepared by double jet precipitation. The emulsion contained 20 mg rhodium chloride per mole of silver halide to increase gradient. The emulsion was dispersed in gelatin and the pH adjusted to 7.6.

Figure 2:
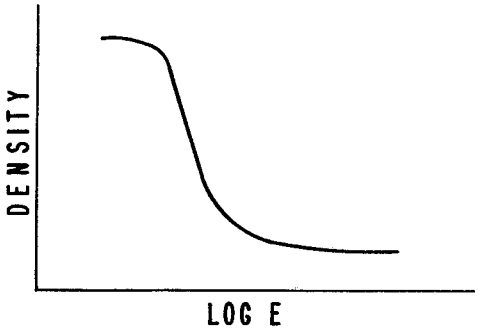

A portion of this emulsion was used as a control and was digested for 90 minutes at 73° C. after the addition of 25 micrograms of cesium thiadecaborane and 47 micrograms of gold chloride per mole of silver halide. After digestion the emulsion was cooled to 35° C. and the pH adjusted to 5.4; cetyl betaine was added as a coating aid, and formaldehyde as a hardener. The emulsion was coated on a film support and samples were tested by exposing for 1.6 sec. with an EK101 sensitometer through a $\sqrt{2}$ wedge followed by a 90 second development at 27° C. in 24 DL (commercial developer available from Du Pont). FIG. 2 represents the photographic response obtained from this control test, and can be characterized as a typical prefogged direct positive Density vs. Log E curve shape produced by a single emulsion in which the silver halide grains have been uniformly sensitized.

Figure 3:
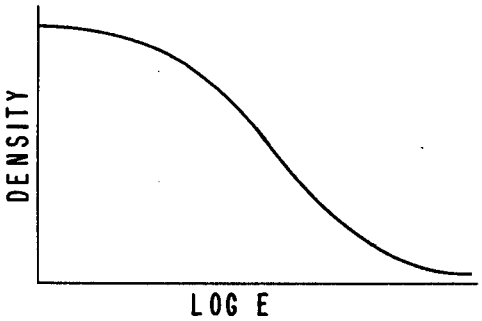
FIGS. 3–6 are Density vs. Log E curves which demonstrate various embodiments of the present invention, as further described in the Examples.
Figure 7:
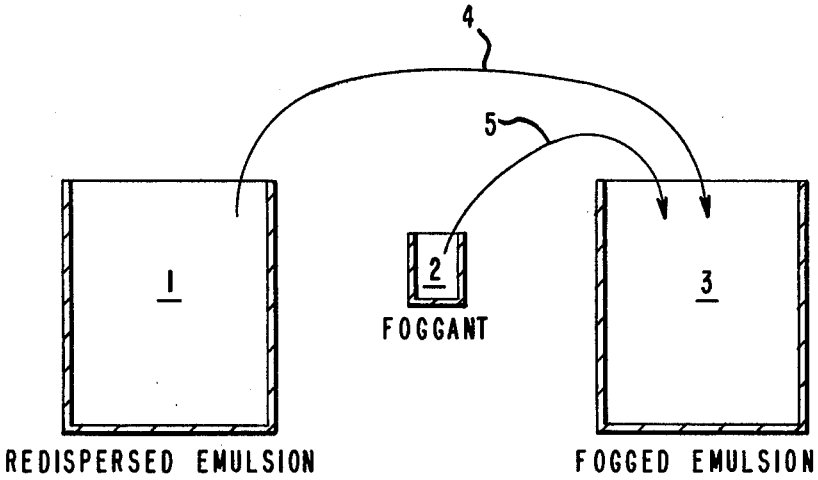
FIGS. 7–8 are schematic illustrations of processes for the preparation of the nonuniform prefogged direct positive emulsions of the present invention.

An experimental portion of the emulsion received the same 47 micrograms of gold chloride as the control but the cesium thiadecaborane was added by a novel method. Referring to FIG. 7, the emulsion was continuously pumped over 80 minutes from a holding vessel 1, through line 4, to a reaction vessel 3 where the internal temperature was maintained at 73° C. over a period of 90 minutes. The 25 micrograms of cesium thiadecaborane was added from container 2 through line 5 as aliquot of solution in the following manner: at reaction time zero, 96 ml; after 10 minutes, 84 ml; after 20 minutes, 72 ml; after 30 minutes, 60 ml; after 60 minutes, 24 ml; and after 70 minutes, 12 ml was the final addition. The digestion was cooled to 35° C. at the end of the 90 minute reaction period, the pH adjusted to 5.4, and cetyl betaine and formaldehyde added as for the control. When a film was prepared and tested as for the control, the FIG. 3 curve was produced. FIG. 3 can be characterized as a representation of a single emulsion nonuniformly fogged according to the present invention. By comparison with FIG. 1, it has the extended latitude or long scale, but without the steps or breaks in the curve. By comparison with FIG. 2, it has the same smooth continuous curve, but with lower gradient and extended latitude or longer scale.

The following Table contains a comparison of the results with and without gold addition.

TABLE 1

| Gold Addition | Fogging | $\gamma$ | Average Gradient | Log Exposure Range |
|---|---|---|---|---|
| No | Std(Control) | 1.9 | 1.7 | 1.20 |
| No | Aliquot foggant | 1.2 | 1.0 | 1.90 |
| Yes | Std(Control) | 2.7 | 2.0 | 1.05 |
| Yes | Aliquot foggant | 1.2 | 1.0 | 2.00 |

These results illustrate the improvement in exposure latitude or longer scale produced by the nonuniform introduction of foggant to the emulsion. As the emulsion enters the reaction vessel 3 at different times the amount of foggant is changing due to a depletion by consumption, and new addition of aliquots. Also, depending on when the emulsion enters vessel 3, it will be held at digestion temperature for varying times. Thus it can be seen that the silver halide grains will experience a wide range of spectrum of reaction conditions. Grains which entered the vessel initially have been present for all aliquot additions. Grains which entered the vessel with the end of the 80 minute addition have been present for the minimum reaction period under fogging conditions. Since all the aliquots have been previously added, the activity of the foggant has already been diminished by prior reaction. Between these extremes are grains with intermediate sensitivities to provide the smooth-continuous curve characteristic of the present invention.

EXAMPLE 2

The speeds of both the control portion and the experimental portion of Example 1 were increased without adversely affecting the extended latitude when a desensitizing dye of the following formula was included in both emulsions:

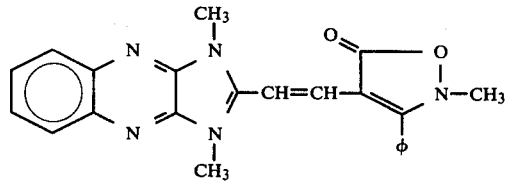

EXAMPLE 3

The speeds of both the control portion and the experimental portion of Example 1 were increased without adversely affecting the extended latitude when tribromoquinaldine was added at the end of digestion as taught in Belgium Pat. No. 876,734.

EXAMPLE 4

A control emulsion was prepared as in Example 1 but the experimental emulsion was prepared by adding aliquots of both emulsion and foggant to the reaction vessel 3. Equal portions of emulsion were added every 10 minutes over the 80 minute period so that the total amount of emulsion was present for the final 10 minutes of the digestion. The foggant was added in milliliters as follows:

| | |
|---|---|
| Add 1 | 96 |
| Add 2 | 84 |
| Add 3 | 72 |
| Add 4 | 60 |
| Add 5 | 48 |
| Add 6 | 36 |
| Add 7 | 24 |
| Add 8 | 12 |

The curve shape obtained is illustrated in FIG. 3. An examination of this result reveals that there is no disadvantage to using aliquot or portion addition of the emulsion relative to the continuous addition described in Example 1.

EXAMPLE 5

Figure 4:
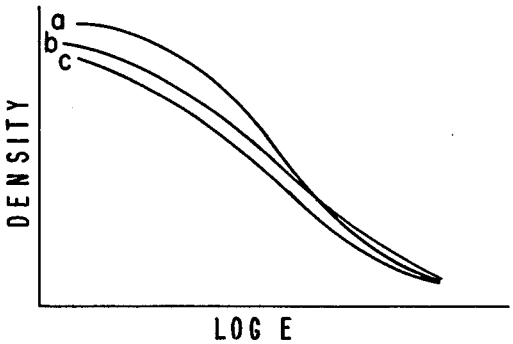

Control and experimental emulsions were prepared which contained the emulsion of Example 1, the desensitizing dye of Example 2, and the tribromoquinaldine of Example 3. All emulsion contains 47 micrograms of gold chloride per mole of silver halide prior to the fogging reaction. Referring to Table 2, in the Control (Col. #1) the amount of emulsion employed in line 1 of the data (Time Min.=0) was 900 units, and was zero thereafter. The emulsion was added in 9 equal portions of 100 units each in the experimental emulsions (Cols. #2–5), along with the indicated amount of foggant. The curve of FIG. 4 demonstrates how different modes of nonuniform fogging can vary the resulting curve shape. Curve (a) represents the mode of adding the foggant at a constant rate. Curve (b) represents the mode of gradually reducing the rate of addition of the foggant. Curve (c) represents the mode of starting with a very high rate of addition of foggant and then rapidly decreasing the rate of foggant addition until it reaches a very low level toward the end of the fogging reaction period. These smooth and continuous curves illustrate that it is possible to maintain the extended latitude advantages of the invention while altering the shape of the curve.

TABLE 2

| Time Min. | Control 1 Foggant Amount | Experiment 2 | 3 | 4 | 5 |
|---|---|---|---|---|---|
| 0 | 70 | 18 | 9 | 25 | 30 |
| 10 | 0 | 13 | 9 | 8 | 10 |
| 20 | 0 | 10 | 9 | 7 | 10 |
| 30 | 0 | 8 | 9 | 7 | 5 |
| 40 | 0 | 6 | 9 | 7 | 5 |
| 50 | 0 | 5 | 9 | 7 | 5 |
| 60 | 0 | 4 | 9 | 6 | 3 |
| 70 | 0 | 3 | 9 | 6 | 3 |

TABLE 2-continued

| Time Min. | Control 1 Foggant Amount | Experiment 2 | 3 | 4 | 5 |
|---|---|---|---|---|---|
| Dmax | 2.3 | 2.2 | 2.3 | 2.2 | 2.1 |
| $\gamma$ | 2.7 | 0.95 | 1.25 | 1.0 | 0.85 |
| Ave. Grad. | 2.0 | 0.75 | 0.95 | 0.85 | 0.75 |
| Total Scale | 1.05 | 2.1 | 1.5 | 1.8 | 1.8 |

Figure 5:
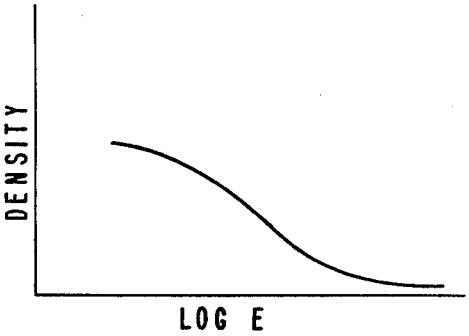

Experimental emulsion 2, characterized by the addition of equal portions of emulsion and gradually decreasing portions of foggant, gives a curve shape which gives a very close match to the $\gamma=1$ curve and is illustrated in FIG. 5. This represents the best mode contemplated for practice of the invention.

EXAMPLE 6

A control and experimental emulsion were prepared as in Example 2 except that the foggant was pumped from container 2 at a continuously decreasing rate. Since both emulsion and foggant were pumped, this illustrates what has been referred to as double jet fogging.

Figure 6:
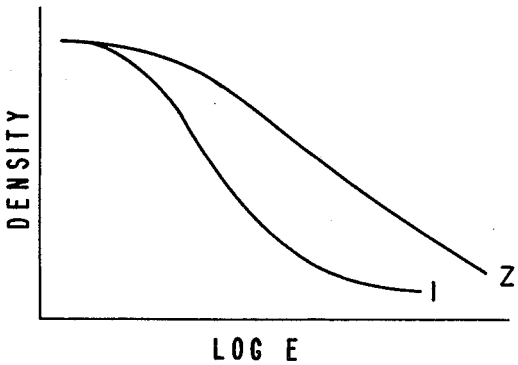

These double jet experiments are illustrated by FIG. 6 in which curve 1 represents the control and curve 2 represents the same emulsion with double jet fogging. This represents the advantage obtained by the present invention. Curve 1 shows the normal curve response of grains fogged in a conventional manner. Curve 2 shows the response obtained with the same grains when they are nonuniformly fogged, using a double jet fogging reaction wherein both emulsion and foggant are continuously added to a reaction vessel.

EXAMPLE 7

A chloride precipitated bromide-converted emulsion was prepared by the conventional splash technique and exhibited heterodisperse grains instead of the monodisperse grains used in the previous examples. The grains were nonuniformly fogged as in Example 4 except that the emulsion and foggant were added at 5 minute intervals as follows:

| | |
|---|---|
| Add 1 | 48 |
| Add 2 | 42 |
| Add 3 | 37 |
| Add 4 | 30 |
| Add 5 | 24 |
| Add 6 | 18 |
| Add 7 | 12 |
| Add 8 | 6 |
| Add 9 | 0 |

As in Ex. 4, the results are illustrated by the curve shape of FIG. 3. This illustrates that the technique is not limited to monodisperse grains but is generally applicable to any silver halide grains useful in direct positive emulsions.

EXAMPLE 8

Two portions of emulsion were prepared as in Example 1 which contained identical amounts of gold and foggant. One of these served as a control and was digested for 90 minutes at 73° C. as in Example 1.

Figure 8:
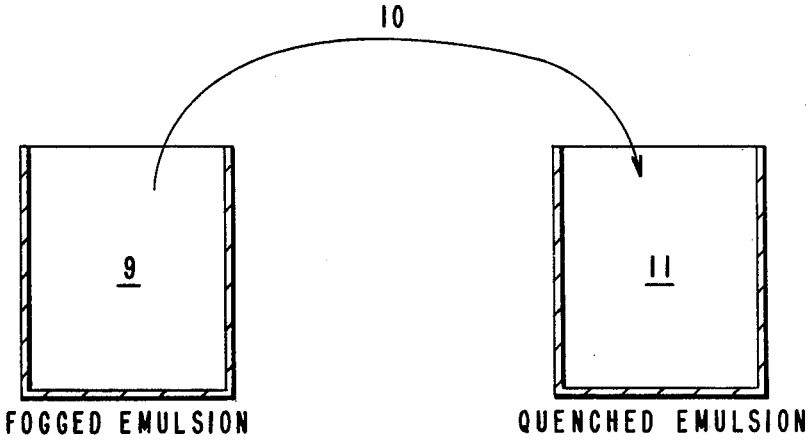

The other portion had eight aliquots of emulsion removed each 10 minutes and cooled to 48° C. during the digestion so that at the end of the 90 minutes the final aliquot was cooled or quenched. The experiment showed extended exposure latitude relative to the control as in FIG. 6. The experiment is illustrated schematically in FIG. 8 of the drawings. Fogged emulsion was removed from vessel 9 at 73° C. as soon as fogging had started, in aliquots, through line 10, over the period of time which is stated, to vessel 11, which was maintained at a temperature of 48° C. Here the fogging reaction was stopped (quenched) by the reduced temperature in vessel 11.

Alternatively, fogging could be stopped in vessel 11 by the addition of a quenching agent instead of by low temperature. Also, the fogged emulsion could be pumped through line 10 at a constant rate instead of in aliquots.

EXAMPLE 9

Emulsions were prepared using the aliquot method of Example 4. For one experiment the foggant additions were varied while the emulsion additions were kept constant, while for the other experiment the foggant additions were kept constant while the emulsion additions were varied. Table 3 contains a comparison of the methods of addition.

TABLE 3

| | Experiment A | | Experiment B | |
|---|---|---|---|---|
| | Emulsion Portion | Foggant Portion | Emulsion Portion | Foggant Portion |
| Time Zero | 100 | 16 | 40 | 6 |
| 10 min. | 100 | 14 | 40 | 6 |
| 20 min. | 100 | 12 | 60 | 6 |
| 30 min. | 100 | 10 | 80 | 6 |
| 40 min. | 100 | 8 | 100 | 6 |
| 50 min. | 100 | 6 | 120 | 6 |
| 60 min. | 100 | 4 | 140 | 6 |

TABLE 3-continued

| | Experiment A | | Experiment B | |
|---|---|---|---|---|
| | Emulsion Portion | Foggant Portion | Emulsion Portion | Foggant Portion |
| 70 min. | 100 | 2 | 160 | 6 |
| 80 min. | 100 | 0 | 190 | 0 |

Both experimental emulsions gave results comparable with curve 2 of FIG. 6 while a control using the same emulsion with all the foggant and emulsion added at the beginning of the 90 minute digestion gave the standard curve 1 of FIG. 6. This illustrates that the nonuniform fogging can be carried out in a variety of ways and that it is possible to obtain the low contrast and long scale in more than one manner.

I claim:

1. A direct-positive photographic element comprising a support having coated thereon a single chemically fogged direct-positive silver halide emulsion, the silver halide grains of which have been fogged to a continuously varying degree and exhibit a multitude of photographic sensitivities within the same emulsion, whereby a Density vs. Log of Exposure curve of said element provides extended exposure latitude and exhibits no discrete steps.

2. A direct-positive photographic element according to claim 1 wherein said emulsions have been reduction- and gold-fogged.

3. The direct-positive photographic element of claim 1 wherein said emulsion, the silver halide grains of which have been fogged to a continuously varying degree, constitutes a single layer in said element.

4. The direct-positive photographic element of claim 1 wherein said fogged emulsion is a monodisperse emulsion.

5. The direct-positive photographic element of claim 1 wherein said fogged emulsion is a heterodisperse emulsion.

* * * * *